US006451248B1

(12) United States Patent
Kinosz et al.

(10) Patent No.: US 6,451,248 B1
(45) Date of Patent: Sep. 17, 2002

(54) PRESSURIZED MOLTEN METAL HOLDER FURNACE

(75) Inventors: Michael J. Kinosz, Apollo; Thomas N. Meyer, Murrysville, both of PA (US); F. Donald Kuhns, Jr., Medina, OH (US); Moustapha Mbaye, Owensboro, KY (US); Jamal Righi, Monroeville, PA (US)

(73) Assignee: Alcoa, Inc., Pittsburgh, PA (US)

( * ) Notice: Subject to any disclaimer, the term of this patent is extended or adjusted under 35 U.S.C. 154(b) by 0 days.

(21) Appl. No.: 09/769,955

(22) Filed: Jan. 25, 2001

(51) Int. Cl.[7] ..... C22B 7/00
(52) U.S. Cl. ..... 266/242; 432/209
(58) Field of Search ..... 266/200, 242, 266/287; 432/157, 209

(56) References Cited

U.S. PATENT DOCUMENTS

| | | | | |
|---|---|---|---|---|
| 3,249,675 A | | 5/1966 | Matchen | |
| 3,293,412 A | | 12/1966 | Profitt et al. | 219/421 |
| 3,688,007 A | | 8/1972 | McKenna et al. | |
| 3,991,263 A | | 11/1976 | Folgero et al. | |
| 4,010,939 A | * | 3/1977 | Allyn et al. | 266/242 |
| 4,033,564 A | * | 7/1977 | Junghanns et al. | 266/242 |
| 4,230,308 A | | 10/1980 | Gueguen | 266/92 |
| 4,263,470 A | | 4/1981 | Sjoberg | |
| 4,299,268 A | | 11/1981 | Lavanchy et al. | 164/155 |
| 4,590,988 A | | 5/1986 | Fukuoka et al. | 164/463 |
| 4,753,283 A | | 6/1988 | Nakano | 164/312 |
| 4,967,827 A | | 11/1990 | Campbell | 164/134 |
| 5,398,750 A | | 3/1995 | Crepeau et al. | 164/154.2 |
| 5,411,240 A | | 5/1995 | Rapp et al. | 266/94 |
| 5,459,748 A | | 10/1995 | Gleichman et al. | 373/132 |
| 5,567,378 A | | 10/1996 | Mochizuki et al. | 266/44 |
| 5,718,416 A | | 2/1998 | Flisakowski et al. | 266/217 |

FOREIGN PATENT DOCUMENTS

| | | | |
|---|---|---|---|
| EP | 37788 A | * | 10/1981 |
| EP | 0510701 | | 10/1992 |
| JP | 359050135 A | * | 3/1984 |
| JP | 6246432 | | 9/1994 |
| JP | 09066357 A | * | 3/1997 |
| WO | 9716051 | | 5/1997 |
| WO | 9737797 | | 10/1997 |

* cited by examiner

*Primary Examiner*—Scott Kastler
(74) *Attorney, Agent, or Firm*—Webb Ziesenheim Logsdon Orkin & Hanson, P.C.

(57) ABSTRACT

A bottom heated holder furnace (10) for containing a supply of molten metal includes a storage vessel (20) having sidewalls (22) and a bottom wall (24) defining a molten metal receiving chamber (26). A furnace insulating layer (32) lines the molten metal receiving chamber (26). A thermally conductive heat exchanger block (50) is located at the bottom of the molten metal receiving chamber (26) for heating the supply of molten metal. The heat exchanger block (50) includes a bottom face (55), side faces (56), and a top face (57). The heat exchanger block (50) includes a plurality of electrical heaters (70) extending therein and projecting outward from at least one of the faces of the heat exchanger block (50), and further extending through the furnace insulating layer (32) and one of the sidewalls (22) of the storage vessel (20) for connection to a source of electrical power. A sealing layer (60) covers the bottom face (55) and side faces (56) of the heat exchanger block (50) such that the heat exchanger block (50) is substantially separated from contact with the furnace insulating layer (32). A gas pressurization valve (118) is in fluid communication with the molten metal receiving chamber (26) and the interior of the heat exchanger block (50) for pressurizing the interior of the holder furnace (10).

25 Claims, 5 Drawing Sheets

PRESSURIZED MOLTEN METAL HOLDER FURNACE

BACKGROUND OF THE INVENTION

1. Field of the Invention

The present invention relates to a holder furnace for containing a supply of molten metal and, more particularly, to a pressurized and bottom heated holder furnace for containing a supply of molten metal.

2. Description of the Prior Art

Molten metal holding furnaces, or holder furnaces, are used in the art for holding and/or melting molten metal. Holding furnaces are often used to contain a supply of molten metal for injection into a casting machine. For example, U.S. Pat. No. 4,753,283 to Nakano discloses a horizontal injection molten metal is maintained in a holding furnace which periodically provides molten metal to the casting machine. Molten metal from a larger smelting furnace is supplied periodically to the holding furnace to maintain a set amount of molten metal in the holding furnace. The holding furnace is heated by a burner located adjacent a sidewall of the holding furnace.

In addition to the burner arrangement disclosed by the Nakano patent, several other methods are known in the art for heating molten metal contained in a holding furnace. Several common methods include induction heating, radiant heating, and immersion heating. For example, U.S. Pat. No. 4,299,268 to Lavanchy et al. discloses a molten metal casting arrangement in which molten metal is contained in a large capacity pressure ladle (i.e., holding furnace) that is heated by a heating inductor located at the bottom of the pressure ladle. The pressure ladle periodically supplies molten metal to a smaller capacity tilting ladle, which supplies molten metal to a casting apparatus. U.S. Pat. No. 3,991,263 to Folgero et al. discloses a similar molten metal holding system to that disclosed by the Lavanchy et al. patent, but the system disclosed by the Folgero et al. patent is pressurized.

U.S. Pat. No. 4,967,827 to Campbell discloses a melting and casting apparatus in which electric radiant heating elements are used to heat molten metal passing from a holding furnace to a casting vessel. U.S. Pat. No. 5,398,750 to Crepeau et al. discloses a molten metal supply vessel in which a plurality of electric immersion heaters is used to heat molten metal in a holding furnace. The immersion heaters extend downward from the holding furnace cover and are partially submerged in the molten metal contained in the holding furnace. U.S. Pat. No. 5,567,378 to Mochizuki et al. discloses a similar immersion heater arrangement to that found in the Crepeau et al. patent.

The above-discussed radiant heating and immersion heating elements for heating molten metal in a holding furnace are located above the surface of the molten metal and are "top" heating arrangements. The "top" heating arrangements known in the art require a significant amount of space above the holding furnace for the individual heating elements. For example, the immersion heaters and electric radiant heaters discussed previously in connection with the Crepeau et al. and Campbell patents require a significant amount of space above the surface of the molten metal in the holding furnace, as well as a support structure above the holding furnace for supporting the heating elements above the surface of the molten metal. External heating arrangements, such as the burner arrangement disclosed by the Nakano patent, heat the holding furnace along a bottom wall or sidewall of the holding furnace, and typically require space along the sides or bottom of the holding furnace for the heating elements. With such top/external heating arrangements, it is difficult to maintain a constant molten metal temperature in the holding furnace.

An alternative to top/external heating arrangements is to provide bottom heating devices in holding furnaces. Such bottom heating devices are typically embedded within the bottom wall of the holding furnace. One known bottom heating arrangement in a molten metal holding furnace is disclosed by U.S. Pat. No. 5,411,240 to Rapp et al. The heating cycle of such bottom heating arrangements places significant stress on the bottom wall of the holding furnace. Such bottom heating arrangements are also generally unsuitable for use with containment difficult metals such as molten aluminum alloys. Any leakage of molten aluminum alloy into the bottom wall of the holding furnace will cause failure of the heating elements.

In view of the foregoing, an object of the present invention is to provide a bottom heated holder furnace having improved molten metal containment characteristics. In addition, it is an object of the present invention to provide a bottom heated holder furnace that is suitable for use with molten aluminum alloys. It is a further object of the present invention to provide a holder furnace that may be cyclically pressurized without large pressure drops occurring within the holder furnace.

SUMMARY OF THE INVENTION

The above objects are accomplished with a pressurized molten metal holder furnace in accordance with the present invention. The holder furnace includes a storage vessel having sidewalls and a bottom wall defining a molten metal receiving chamber for containing the supply of molten metal. At least one furnace insulating layer lines the molten metal receiving chamber of the storage vessel. A thermally conducted heat exchanger block is located at the bottom of the molten metal receiving chamber for heating the supply of molten metal. The heat exchanger block has a top face, a bottom face, and side faces. The heat exchanger block includes a plurality of electrical heaters extending therein and projecting outward from at least one of the faces of the heat exchanger block, and further extending through the furnace insulating layer and at least one of the sidewalls of the storage vessel for connection to a source of electrical power. A sealing layer at least partially covers the bottom face and side faces of the heat exchanger block such that the heat exchanger block is substantially separated from contact with the furnace insulating layer. A gas pressurization valve is in fluid communication with the molten metal receiving chamber and the interior of the heat exchanger block through the electrical heaters. The gas pressurization valve is configured for connection to a gas pressurization source, and further configured to pressurize the molten metal receiving chamber and the heat exchanger block upon connection to the gas pressurization source and activation of the gas pressurization valve.

The holder furnace may include a cover positioned on top of the storage vessel and enclosing the molten metal receiving chamber. The cover may include a first conduit extending therethrough and in fluid communication with the gas pressurization valve for pressurizing the molten metal receiving chamber. The cover may further include a second conduit extending therethrough for removing molten metal from the molten metal receiving chamber upon pressurization.

The portion of the electrical heaters extending outward from the sidewall of the storage vessel may be enclosed in a chamber connected to the gas pressurization valve and configured for pressurization upon activation of the gas pressurization valve. The sealing layer may be an alumina fiber mat. The heat exchanger block may be made of graphite, silicone carbide, or another substantially equivalent material.

The electrical heaters may extend between opposite sidewalls of the storage vessel and through the heat exchanger block. The electrical heaters may each include a continuous heating element extending through at least one of the opposite sidewalls, the at least one furnace insulating layer, and extending at least partially through the heat exchanger block. The electrical heaters may each further include respective tubes extending through the opposite sidewalls, the at least one furnace insulating layer, and extending at least partially into opposite faces of the heat exchanger block. The heating element for the electrical heaters may extend at least partially through each of the respective tubes. Sealing gaskets may be positioned within the heat exchanger block. The sealing gaskets may cooperate, respectively, with ends of the tubes extending into the opposite faces of the heat exchanger block for preventing molten metal from leaking into the tubes and contacting the heating element of the electrical heaters. The tubes may be ceramic insulating tubes that are substantially surrounded by a layer of ceramic fiber rope for preventing molten metal from the supply of molten metal from leaking into the ceramic insulating tubes and contacting the heating elements of the electrical heaters.

Flange plates may be attached, respectively, to the ceramic insulating tubes at the opposite sidewalls of the storage vessel. The ceramic insulating tubes may be held into compression against the opposite sidewalls of the storage vessel via the flange plates, bolts, and a plurality of Belleville washers act to yield about 170 pounds of torque on each of the ceramic insulating tubes.

The sealing layer may further extend along a portion of the top face of the heat exchanger block. The furnace insulating layer may overlap the sealing layer extending along the top face of the heat exchanger block. The portion of the top face of the heat exchanger block having the sealing layer thereon may define a non-linear path such that any molten metal leakage into the furnace insulating layer follows a torturous path along the sealing layer. A portion of the top face of the heat exchanger block having the sealing layer thereon may also define a plurality of ribs such that any molten metal leakage into the furnace insulating layer follows a torturous path along the sealing layer.

Further details and advantages of the present invention will become apparent from the following detailed description in conjunction with the drawings wherein like parts are designated with like reference numerals throughout.

DETAILED DESCRIPTION OF THE PREFERRED EMBODIMENTS

Figure 2:
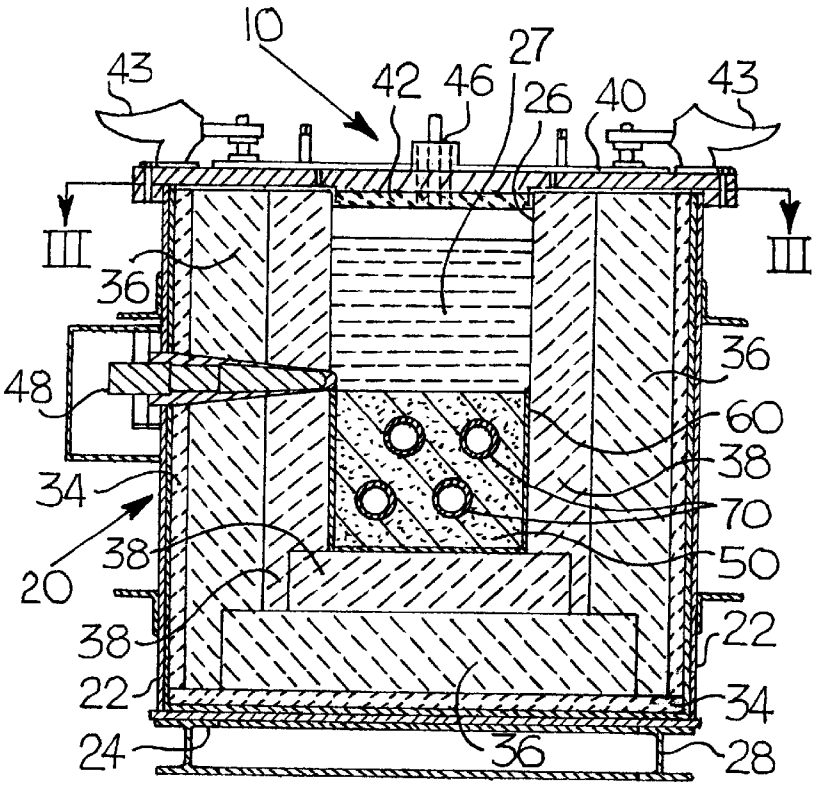
FIG. 2 is a cross-sectional end view of the holder furnace of FIG. 1 viewed from an opposite end of the holder furnace from the cross-sectional view shown in FIG. 1.
Figure 1:
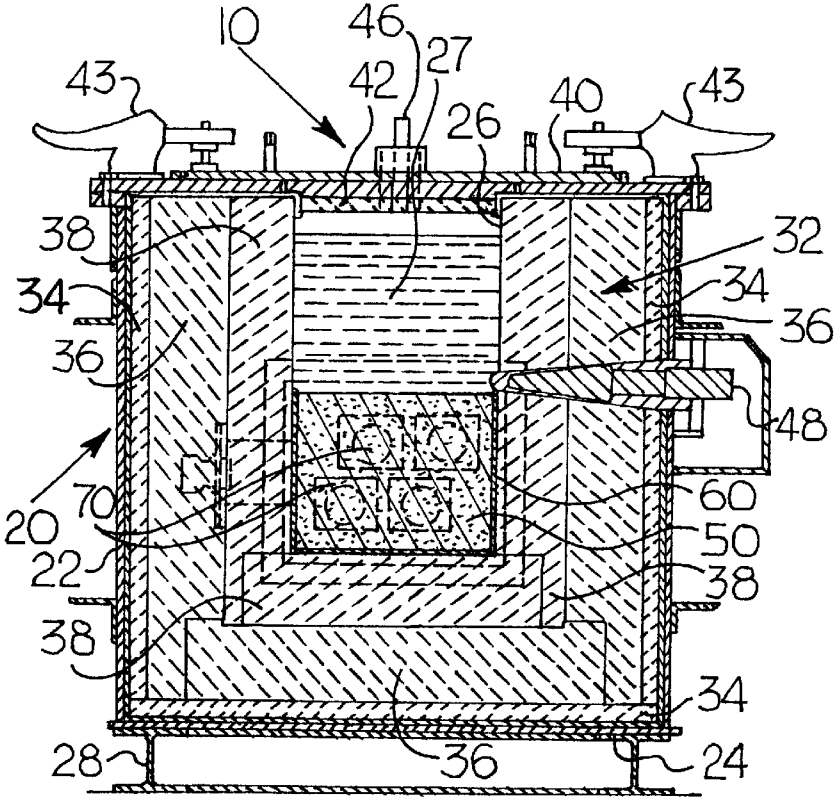
FIG. 1 is a cross-sectional end view of a holder furnace made in accordance with the present invention.
Figure 5:
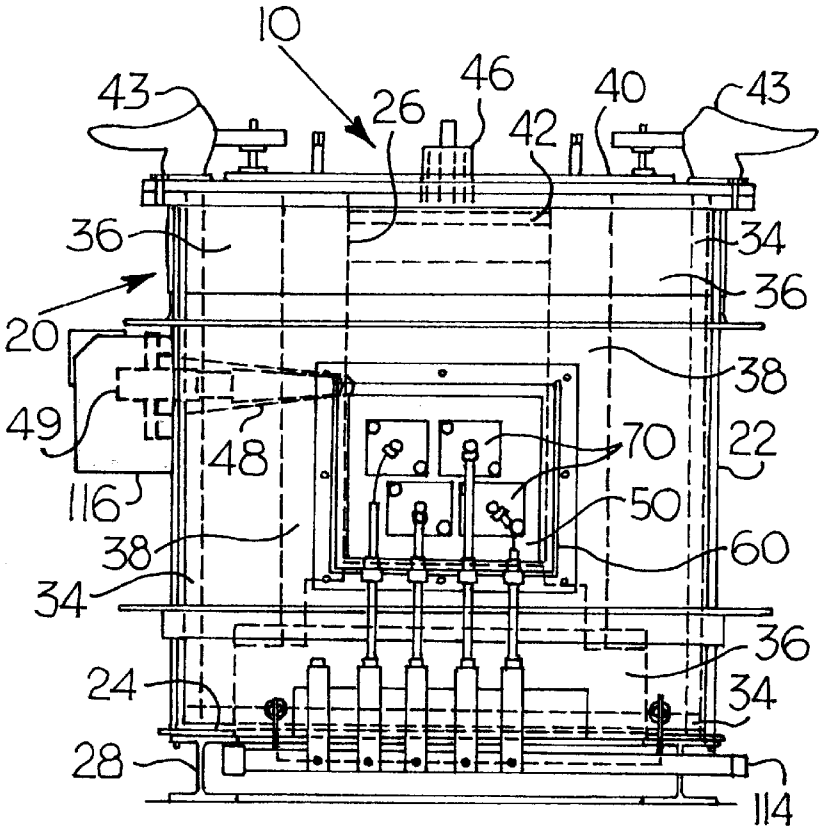
FIG. 5 is an end view of the holder furnace of FIG. 2 showing hidden lines.

Referring to FIGS. 1–5 a molten metal holder furnace 10 made in accordance with the present invention is shown. The holder furnace 10 may be used as part of a molten metal casting system, a degassing furnace, as part of a molten metal filtration system, or in other ways customary in the art. The holder furnace 10 is generally defined by a storage vessel 20 having sidewalls 22 and a bottom wall 24, which generally enclose a molten metal receiving chamber 26 of the holder furnace 10. The molten metal receiving chamber 26 is configured to contain a supply of molten metal 27. The storage vessel 20 may be made of metal and, preferably, steel. The storage vessel 20 includes a base support structure 28 for supporting the holder furnace 10.

The holder furnace 10 includes a plurality of furnace lining layers 32 lining the molten metal receiving chamber 26. In a preferred embodiment of the holder furnace 10, three furnace lining layers 32 line the molten metal receiving chamber 26. The furnace layers 32 may be cast as individual blocks within the molten metal receiving chamber 26. A first layer 34 of the furnace lining layers 32 lies immediately adjacent and in contact with the sidewalls 22 and bottom wall 24 of the storage vessel 20. The first layer 34 is preferably a thermal insulation layer and may have a thickness of about one inch. The first layer 34 is preferably a microporous, primarily pressed silica powder (50–90%) material that is encapsulated in a woven fiberglass cloth. A suitable thermal insulating material for the first layer34 includes Microtherm manufactured by Microtherm Inc., Maryville, Tenn.

A second layer 36 is positioned radially inward from the first layer 34 and is in contact therewith. The second layer 36 is preferably an aluminum-resistant, insulating and castable material. The second layer 36 may be comprised of primarily silica and alumina, and is preferably light in weight and possesses low thermal conductivity properties. A suitable aluminum-resistant, lightweight, insulating, and castable material for the second layer 36 may include approximately 35% silica and 45% alumina by weight. A suitable aluminum-resistant, lightweight, insulating, and castable material for the second layer 36 includes ALSTOP™ Lightweight Castable manufactured by A. P. Green, Minerva, Ohio.

A third layer 38 of the furnace lining layers 32 lies radially inward from the second layer 36 and is in contact therewith. The third layer 38 is preferably a high alumina content castable layer. For example, the third layer 38 may include about 70–90% alumina by weight. A suitable material for the third layer 38 includes Grefcon™ 80A manufactured by RHI Refractories America and having an alumina content of about 80% by weight. The furnace lining layers 32 generally separate the sidewalls 22 and bottom wall 24 of the storage vessel 20 from the molten metal 27 contained in the molten metal receiving chamber 26.

A furnace cover 40 is positioned on top of the storage vessel 20 to substantially enclose the molten metal receiving chamber 26, and preferably provides a substantially air tight seal for the molten metal receiving chamber 26. The furnace cover 40 may be made of metal, such as steel, and preferably includes an insulating layer 42 facing the molten metal receiving chamber 26 to protect the furnace cover 40 from contact with the molten metal 27 contained in the molten metal receiving chamber 26. The insulating layer 42 is preferably an insulating blanket material. The insulating blanket material protects the furnace cover 40 from warping because of the high heat of the molten metal 27 in the molten metal receiving chamber 26. Suitable materials for the insulating material include any of the materials discussed previously in connection with the furnace lining layers 32, such as Microtherm, ALSTOP™ Lightweight Castable, and includes Grefcon™ 80A, or substantially equivalent materials. Another suitable material for the insulating layer 42 includes Maftec™ manufactured by Thermal Ceramics Inc., Augusta, Ga. This material is a heat storage multi-fiber blanket material that is heat resistant to about 2900° F. The furnace cover 40 may be held in place by a plurality of clamps 43 and bolts.

The holder furnace 10 of the present invention is a "batch" type holder furnace which requires that the furnace cover 40 be removed periodically to replenish the supply of molten metal 27 in the molten metal receiving chamber 26. The furnace cover 40 includes a first conduit 44 extending therethrough and which use is described further hereinafter. The furnace cover 40 further includes a second conduit, or pressure tube 46, also extending through the furnace cover 40, and which is used to extract the molten metal 27 from the holder furnace 10 during its operation. The pressure tube 46 may, for example, be used to place the holder furnace 10 in fluid communication with a casting machine (not shown). The holder furnace 10 would thus supply the molten metal 27 to the casting machine through the pressure tube 46 during operation of the holder furnace 10.

The holder furnace 10 further includes a drain conduit 48 for draining the molten metal 27 from the molten metal receiving chamber 26. The drain conduit 48 extends through the furnace lining layers 32 and is in fluid communication with the molten metal receiving chamber 26. Often, it may become necessary to entirely replace the molten metal 27 in the molten metal receiving chamber 26 with a different molten metal alloy, or move the holder furnace 10 to a different location. The drain conduit 48 enables removal of the molten metal 27 from the molten receiving chamber 26. A drain plug 49 is used to seal the drain conduit 48 when the holder furnace 10 is in operation.

The first conduit 44, second conduit or pressure tube 46, and drain conduit 48 are each preferably lined with a refractory material that is suitable for use with molten aluminum alloys. Suitable refractory materials include Permatech™ Sigma or Beta II castable refractory materials manufactured by Permatech, Inc., Graham, N.C. Permatech™ Sigma refractory material is mainly comprised of about 64% silica, 30% calcium aluminate cement, and 6% chemical frits by weight, and Permatech™ Beta II refractory material is mainly comprised of about 62% alumina and 29% silica by weight.

The holder furnace 10 includes a rectangular-shaped heat exchanger block 50 located at the bottom of the molten metal receiving chamber 26 defined by the storage vessel 20. The heat exchanger block 50 is used to heat the molten metal 27 received in the molten metal receiving chamber 26. Thus, the holder furnace 10 is generally heated from the bottom. The heat exchanger block 50 is thermally conductive, and is preferably made of graphite, silicon carbide or another material having similar thermally conductive properties. The heat exchanger block 50 may be provided as a single, large heat exchanger block having dimensions conforming to the size of the molten metal receiving chamber 26, or as several individual blocks (not shown) connected together along longitudinal side or end edges by a tongue-in-groove connection. A preferred tapered angle for such tongue-in-groove connection may be about 5°. The heat exchanger block 50 generally has a bottom face 55, side faces 56, and a top face 57.

The heat exchanger block 50 is partially covered or enclosed by a sealing layer 60. In particular, the sealing layer 60 preferably covers the heat exchanger block 50 on the bottom face 55 and side faces 56 of the heat exchanger block 50. The exposed top face 57 of the heat exchanger block 50 defines a heat transfer surface of the heat exchanger block 50. The top face 57, or heat transfer surface, is intended for direct contact with the molten metal 27 contained within the molten metal receiving chamber 26. In summary, the sealing layer 60 generally separates the bottom face 55 and side faces 56 of the heat exchanger block 50 from contact with the furnace lining layers 42. The sealing layer 60 is preferably an alumina fiber mat material. A suitable material for the sealing layer 60 is sold under the trademark SAFIL™ Alumina LD Mat, and manufactured by Thermal Ceramics, Augusta. Ga. The sealing layer 60, for example, may include about 90–96% alumina fibers by weight.

The heat exchanger block 50 further includes a plurality of electrical heaters 70 which are used to heat the heat exchanger block 50 and, further, the molten metal 27 received in the molten metal receiving chamber 26. The embodiment of the holder furnace 10 shown in FIGS. 1–5 includes a total of four electrical heaters 70. However. it will be appreciated by those skilled in the art that the heat exchanger block 50 may include any number of electrical heaters 70. The electrical heaters 70 may, for example, be resistive type electrical heating heaters that extend completely or partially through the heat exchanger block 50.

The details of the heat exchanger block 50 and plurality of electrical heaters 70 shown in FIGS. 1–5 will now be discussed in detail with reference to FIGS. 3–6. It will be apparent that the electrical heaters 70 shown in FIGS. 3–6 are identical, and a discussion of the details of one of the electrical heaters 70 will be illustrative of all of the electrical heaters 70 shown in FIGS. 3–6.

Figure 3:
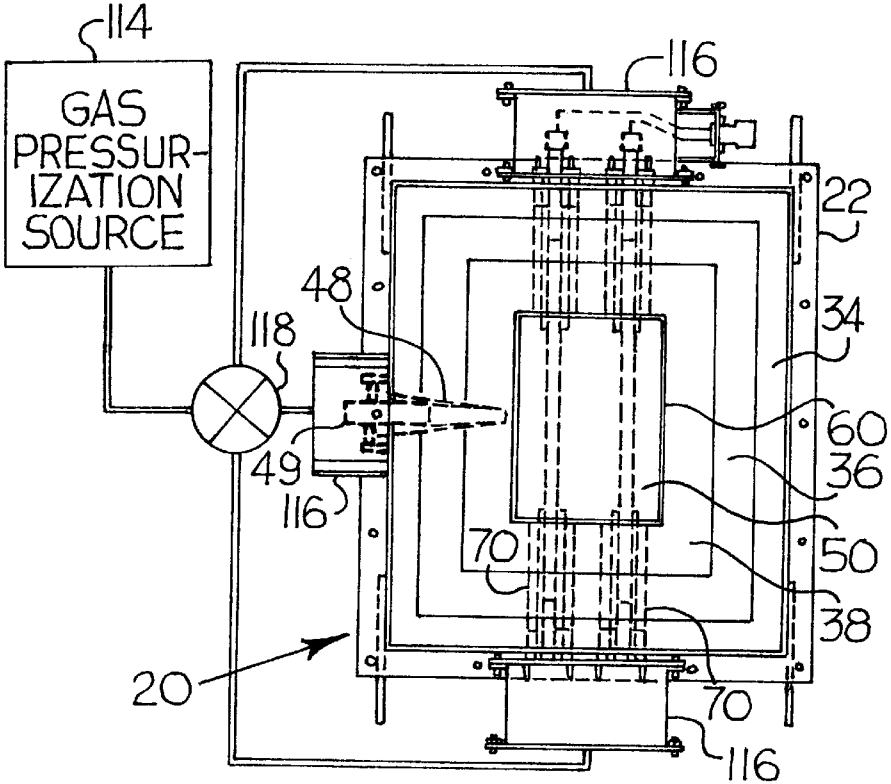
FIG. 3 is a cross-sectional top view of the holder furnace of FIGS. 1 and 2 taken along lines III—III in FIG. 2.
Figure 4:
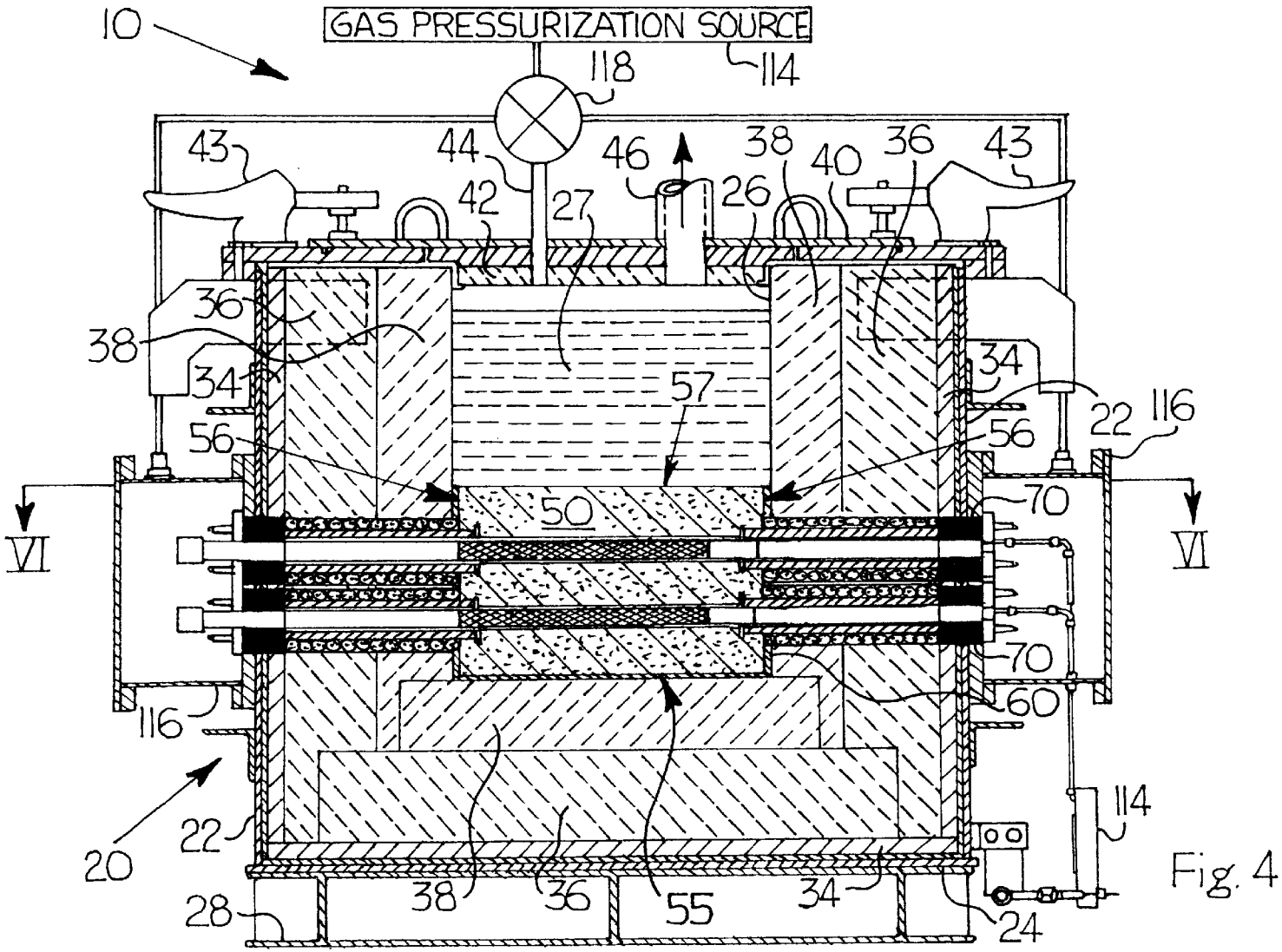
FIG. 4 is a cross-sectional side view of the holder furnace of the present invention.

The electrical heater 70, in a preferred embodiment, extends between opposite sidewalls of the storage vessel 20. The opposite sidewalls of the storage vessel 20 are designated with reference numerals 22A, 22B, respectively, and will be referred to as first sidewall 22A and second sidewall 22B hereinafter for clarity. The electrical heater 70 preferably extends through the first sidewall 22A, the furnace insulating layers 32, the heat exchanger block 50, and the second sidewall 22B of the storage vessel 20. In FIGS. 3 and 4, the electrical heater 70 extends substantially parallel to a longitudinal axis of the holder furnace 10. However, the present invention envisions that the electrical heater 70 may be oriented transverse to the longitudinal axis of the holder furnace 10, or at any other orientation as long as the electrical heater 70 extends substantially through the heat exchanger block 50.

The electrical heater 70 includes a continuous heating element 76 that extends through the first sidewall 22A, the furnace insulating layers 32, and extends substantially through the heat exchanger block 50. A portion 78 of the continuous heating element 76 projects outward from one of the side faces 56 of the heat exchanger block 50. The opposite side faces of the heat exchanger block 50 are designated with reference numerals 56A, 56B, respectively, and will be referred to hereinafter as first side face 56A and second side face 56B for clarity. The continuous heating element 76 is preferably a resistive type electrical heating element. For aluminum alloy applications, the heating element 76 is preferably sized to maintain a system temperature of between about 1300–1500° F. and preferably about 1400° F.

The heating element 76 includes an end 80, or "cold toe", which terminates within the heat exchanger block 50. The portion 78 of the heating element 76 that projects outward from the first side face 56A of the heat exchanger block 50 is preferably enclosed by a first insulating tube 82. The first insulating tube 82 extends through the first sidewall 22A, the furnace lining layers 32, and extends partially into the first side face 56A of the heat exchanger block 50. A second insulating tube 84 preferably extends through the second sidewall 22B, the furnace insulating layers 32, and extends partially into the second side face 56B of the heat exchanger block 50. A first sealing gasket 92 is located within the heat exchanger block 50 adjacent the end of the first insulating tube 82 extending into the heat exchanger block 50 at the first side face 56A. The first sealing gasket 92 cooperates with the end of the first insulating tube 82 for preventing the molten metal 27 from contacting the continuous heating element 76. A second sealing gasket 94 is located within the heat exchanger block 50 adjacent the end of the second insulating tube 84 extending into the heat exchanger block 50 at the second side face 56B. The second sealing gasket 94 cooperates with the end of the second insulating tube 84 extending into the heat exchanger block 50 at the second side face 56B for preventing the molten metal 27 from contacting the continuous heating element 76.

The first and second insulating tubes 82, 84 are preferably ceramic insulating tubes. The first and second sealing gaskets 92, 94 are preferably made of an alumina fiber mat material having a high alumina fiber content similar to the material used for the sealing layer 50. A suitable material for the first and second sealing gaskets 92, 94 is sold under the trademark SAFIL™ Alumina LD Mat and manufactured by Thermal Ceramics, Augusta, Ga., as discussed previously in connection with the sealing layer 60.

The first and second insulating tubes 82, 84 are preferably each surrounded by a layer of ceramic fiber rope 100 for preventing the molten metal 27 from leaking into the first and second insulating tubes 82, 84 and contacting the continuous heating elements 76. A suitable ceramic fiber rope material includes Fiberfrax high density rope manufactured by the Carborundum Company, Niagara Falls, N.Y. Fiberfrax is comprised mainly of aluminia-silica. Flange plates 102 are attached, respectively, to the first and second insulating tubes 82, 84 at the first and second sidewalls 22A, 22B of the storage vessel 20. The first and second insulating tubes 82, 84 are preferably held in compression against the first and second sidewalls 22A, 22B of the storage vessel 20 by the flange plates 102, bolts 104, and a plurality of washers 106. The washers 106 are preferably Belleville spring washers, which are stacked on the bolts 104 to yield about 175 pounds of torque on the first and second insulating tubes 82, 84. Thus, the first and second insulating tubes 82, 84 are held in compression against the first and second sidewalls, or opposite sidewalls 22A, 22B of the storage vessel 20 to counteract the thermal expansion of the heat exchanger block 50 under heating conditions.

The electrical heater 70 and, more particularly, the continuous heating element 76 are connected to a source of electrical power 112, which provides electrical power to the continuous heating element 76. As stated previously, the construction of the electrical heater 70 discussed hereinabove is identical for each of the electrical heaters 70 used in the heat exchanger block 50. A preferred embodiment of the holder furnace 10 includes a set of four electrical heaters 70.

Figure 6:
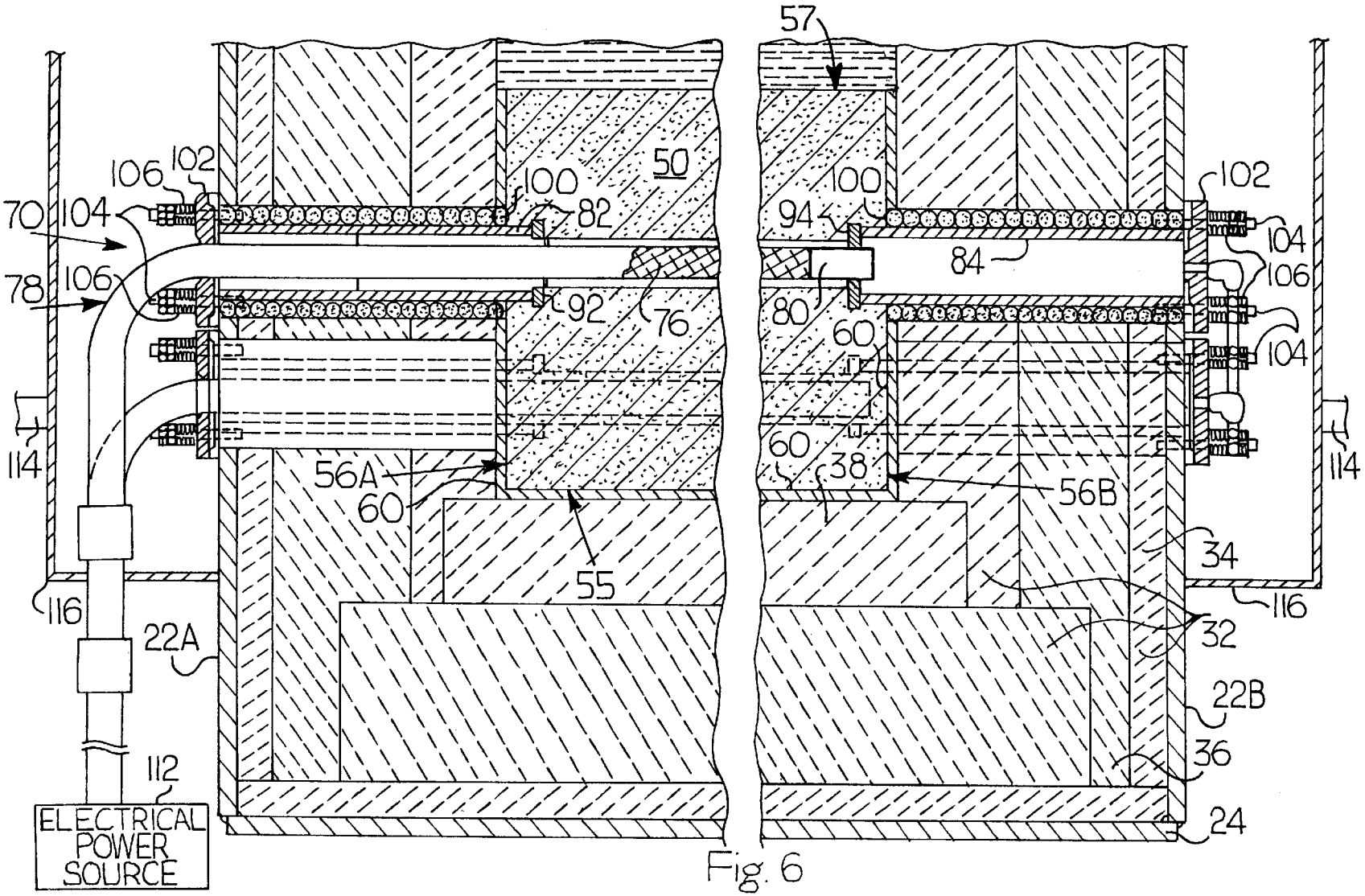
FIG. 6 is a cross-sectional side view of the holder furnace of FIG. 4 taken along lines VI–VI in FIG. 4.

Referring, in particular, to FIGS. 3, 4, and 6, the holder furnace 10, in operation, is preferably pressurized by an external gas pressurization source 114. To accomplish this, the holder furnace 10 preferably includes a plurality of chambers 116 that respectively enclose the drain conduit 48 and the first and second insulating tubes 82, 84 extending outward from the opposite sidewalls 22A, 22B of the storage vessel 20. Each of the chambers 116 is connected to a gas pressurization valve 118, which in turn is connected to the gas pressurization source 114. The gas pressurization valve 118 is also connected to the first conduit 44 passing through the furnace cover 40 for pressurizing the molten metal receiving chamber 26. The chambers 116 enclosing the first and second insulating tubes 82, 84 may be pressurized to pressurize the interior of the heat exchanger block 50. The gas pressurization valve 118 may be a three-way solenoid valve, another type of control valve, or a simple hand operated valve. A suitable valve includes ASCO 110 volt three-way solenoid valve manufactured by Automatic Switch Co., Florham, N.J.

Alternatively to the configuration described hereinabove, the chambers 116 around the first and second insulating tubes 82, 84 may be dispensed with entirely with suitable piping arrangements substituted in their place. In such an arrangement, the gas pressurization valve 118 would be in fluid communication with each of the first and second insulating tubes 82, 84 individually, as will be appreciated by those skilled in the art. Likewise, the chamber 116 around the drain conduit 48 may be dispensed with and a conduit (i.e., pipe, not shown) placed in direct fluid communication with the gas pressurization valve 118. The gas pressurization valve 118 is preferably configured to pressurize the entire interior of the holder furnace 10. In particular, when the gas pressurization valve 118 is open, gas from the gas pressurization source 114 will simultaneously pressurize the molten metal receiving chamber 26 and the interior of the heat exchanger block 50 such that a uniform pressure exists within the holder furnace 10. The gas pressurization valve 118 arrangement described hereinabove will substantially prevent pressure differences from occurring within the holder furnace 10 interior. The holder furnace 10, when pressurized, will be of increased pressure relative to atmospheric pressure outside the holder furnace 10, but there will be no substantial pressure gradients within the holder furnace 10.

A test unit, i.e., holder furnace, was designed and built incorporating the pressurizing features described hereinabove. The test unit was pressurized and depressurized without experiencing any problems. The data from the test pressurization is shown in Table I hereafter:

TABLE I

| | | | | |
|---|---|---|---|---|
| Cycling Pressure (psig) | 4.2 | 6.4 | 8.0 | 10.3 |
| Number of Cycles | 935 | 631 | 935 | 2043 |
| Pressurization/Release Time (sec) | 100/100 | 110/115 | 130/135 | 155/155 |

In view of the foregoing, when electrical power is supplied to the electrical heaters 70 and, in particular, the continuous heating elements 76, the heat exchanger block 50 is heated. The exposed heat transfer surface along the top face 57 of the heat exchanger block 50, which is in contact with the molten metal 27 in the molten metal receiving chamber 26, heats the molten metal 27. The molten metal 27 in the molten metal receiving chamber 26 may, therefore, be kept at a substantially uniform temperature. When the desired molten metal temperature is established, the holder furnace 10 may be pressurized to force the molten metal 27 contained in the molten metal receiving chamber 26 out of the holder furnace 10 via the pressure tube 46. When the gas pressurization valve 118 is open, the chambers 116 enclosing the drain conduit 48 and the first and second insulating tubes 82, 84 are pressurized, which pressurizes the interior of the heat exchanger block 50. Further, opening gas pressurization valve 118 also pressurizes the molten metal receiving chamber 26 through the first conduit 44 extending through the furnace cover 40. As an example, the holder furnace 10 may be pressurized to 10–15 psig. The gas pressurization source 114 may be a source of inert gas, such as nitrogen or argon, or simply compressed air. The pressure drop throughout the holder furnace 10 interior remains small at all times and on the order of less than 0.1 psig with the pressurizing arrangement discussed hereinabove.

Figure 7:
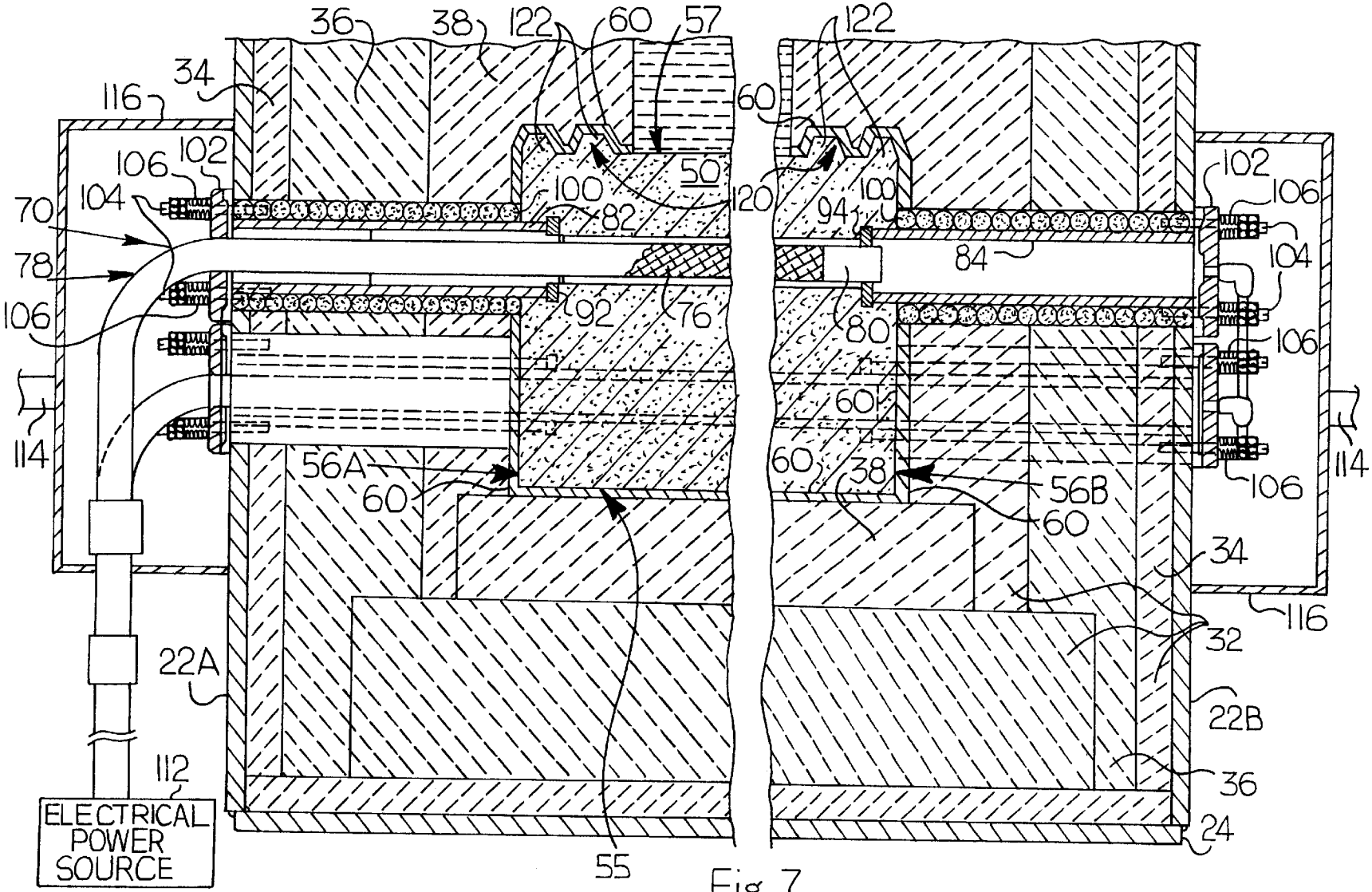
FIG. 7 is a partial cross-sectional side view of an alternative molten metal sealing arrangement for the holder furnace of the present invention.

Referring now to FIG. 7, an alternative sealing arrangement between the heat exchanger block 50 and the furnace insulating layers 32 is shown. In the alternative arrangement, a portion 120 of the top face 57 of the heat exchanger block 50 defines a "torturous" path to the third insulating layer 38, which generally means that the path is non-linear. The torturous, non-linear path shown in FIG. 7 is formed by a plurality of ribs 122 formed on the top face 57 of the heat exchanger block 50. The sealing layer 60, discussed previously, preferably covers the portion 120 of the top face 57 of the heat exchanger block 50 defining the torturous, non-linear path. The torturous, non-linear path is used to increase the distance that any leaking molten metal must travel. Although ribs 122 are shown in FIG. 7, the configuration may take on many geometries as long as the length of the travel path for the molten metal 27 is increased. The innermost furnace insulating layer 32, the third layer 38, preferably overlaps the sealing layer 60 extending along the top face 57 of the heat exchanger block 50. The third layer 38 may be widened to partially overlap the edges of the top face 57. The weight of the third layer 38 compresses the sealing layer 60, and further enhances the sealing characteristics of the sealing layer 60. The alternative sealing arrangement discussed hereinabove advantageously increases the length leaking molten metal 27 must travel, and the molten metal 27 will generally freeze before reaching the sidewalls 22 of the storage vessel 20. This arrangement is particularly well-suited for metals having a low melting point such as molten aluminum alloys.

The present invention provides a bottom heated holder furnace having improved molten metal containment characteristics. The bottom heated holder furnace of the present invention is particularly well-suited for use with molten aluminum alloys and the like because the electrical heaters used to heat the holder furnace are isolated from contact with the molten metal. Furthermore, the holder furnace interior of the present invention may be pressurized without large pressure drops occurring within the holder furnace, thus increasing the pressures at which the holder furnace may operate. The holder furnace of the present invention may be used as part of a molten metal casting system, a degassing furnace, a molten metal filtration system, or in other ways customary in the art.

While preferred embodiments of the present invention were described herein. various modifications and alterations of the present invention may be made without departing from the spirit and scope of the present invention. The scope of the present invention is defined in the appended claims and equivalents thereto.

We claim:

1. A holder furnace, comprising:

a storage vessel having sidewalls and a bottom wall defining a molten metal receiving chamber for containing a supply of molten metal;

at least one furnace insulating layer lining the molten metal receiving chamber of the storage vessel;

a thermally conductive heat exchanger block located at the bottom of the molten metal receiving chamber for heating the supply of molten metal, with the heat exchanger block having a top face, a bottom face, and side faces, and with the heat exchanger block having a plurality of electrical heaters extending therein and projecting outward from at least one of the faces of the heat exchanger block and further extending through the furnace insulating layer and at least one of the sidewalls of the storage vessel for connection to a source of electrical power;

a sealing layer covering the bottom face and side faces of the heat exchanger block such that the heat exchanger block is substantially separated from contact with the furnace insulating layer; and a gas pressurization valve in fluid communication with the molten metal receiving chamber, and in fluid communication with the interior of the heat exchanger block through the electrical heaters, with the gas pressurization valve configured for connection to a gas pressurization source and further configured to pressurize the molten metal receiving chamber and the heat exchanger block upon connection to the gas pressurization source and activation of the gas pressurization valve.

2. The holder furnace of claim 1, further comprising a cover positioned on top of the storage vessel and enclosing the molten metal receiving chamber, with the cover including a first conduit extending therethrough and in fluid communication with the gas pressurization valve for pressurizing the molten metal receiving chamber, and with the cover further including a second conduit extending therethrough for removing molten metal from the molten metal receiving chamber upon pressurization.

3. The holder furnace of claim 1, wherein the portion of the electrical heaters extending outward from the sidewall of the storage vessel is enclosed in a common chamber connected to the gas pressurization valve and configured for pressurization upon activation of the gas pressurization valve.

4. The holder furnace of claim 1, wherein the sealing layer comprises an alumina fiber mat.

5. The holder furnace of claim 1, wherein the heat exchanger block is made of one of graphite and silicon carbide.

6. The holder furnace of claim 1, wherein the electrical heaters extend between opposite sidewalls of the storage vessel and through the heat exchanger block, wherein the electrical heaters each include a continuous heating element extending through at least one of the opposite sidewalls, the at least one furnace insulating layer, and extending at least partially through the heat exchanger block, and wherein the electrical heaters each further include respective tubes extending through the opposite sidewalls, the at least one furnace insulating layer, and extending at least partially into opposite faces of the heat exchanger block, with the heating element for the electrical heaters extending at least partially through each of the respective tubes.

7. The holder furnace of claim 6, further including sealing gaskets positioned within the heat exchanger block, and wherein the sealing gaskets cooperate, respectively, with ends of the tubes extending into the opposite faces of the heat exchanger block for preventing molten metal from leaking into the tubes and contacting the heating element of the electrical heaters.

8. The holder furnace of claim 7, wherein the tubes are ceramic insulating tubes and are each surrounded by a layer of ceramic fiber rope for preventing molten metal from the supply of molten metal from leaking into the ceramic insulating tubes and contacting the heating element of the electrical heaters.

9. The holder furnace of claim 8, further including flange plates attached, respectively, to the ceramic insulating tubes at the opposite sidewalls of the storage vessel, and wherein the ceramic insulating tubes are held in compression against the opposite sidewalls of the storage vessel by the flange plates and mechanical fasteners.

10. A heat exchanger block for heating molten metal in a holder furnace, comprising:

a thermally conductive block having a top face, bottom face, and side faces;

a plurality of continuous h eating elements extending into the thermally conductive block and including a portion projecting outward from one of the side faces of the thermally conductive block;

a first plurality of tubes positioned, respectively, about the portion of the heating elements projecting outward from the thermally conductive block, with the first plurality of tubes extending at least partially into the thermally conductive block;

a first plurality of sealing gaskets located within the thermafly conductive block and positioned, respectively, adjacent ends of the first plurality of tubes extending into the thermally conductive block, with the sealing gaskets cooperating with the ends of the first plurality of tubes for preventing molten metal from contacting the heating elements when the heat exchanger block is used in the holder furnace; and a sealing layer covering the bottom face and side faces of the thermally conductive block.

11. The heat exchanger block of claim 10, wherein the heating elements extend through the thermally conductive block substantially to an opposite side face of the thermally conductive block, with the heating elements each having an end terminating within the thermally conductive block, and with the heat exchanger block further including:

a second plurality of tubes extending at least partially into the opposite side face of the thermally conductive block and cooperating, respectively, with the ends of the heating elements located within the thermally conductive block; and a second plurality of sealing gaskets located within the thermally conductive block and positioned, respectively, adjacent ends of the second plurality of tubes extending into the thermally conductive block at the opposite side face, with the sealing gaskets cooperating with the ends of the second plurality of tubes extending into the thermally conductive block at the opposite side face for preventing molten metal from contacting the heating elements when the heat exchanger block is used in the holder furnace.

12. The heat exchanger block of claim 11, wherein the first and second plurality of tubes are ceramic insulating tubes, and wherein exposed portions of the first and second plurality of ceramic insulating tubes extending outward from the side faces of the thermally conductive block are surrounded by a layer of ceramic fiber rope for preventing molten metal from the holder furnace from leaking into the first and second plurality of ceramic insulating tubes and contacting the heating elements when the heat exchanger block is used in the holder furnace.

13. The heat exchanger block of claim 10, wherein the sealing layer comprises an alumina fibermat.

14. The heat exchanger block of claim 10, wherein the thermally conductive block is made of one of graphite and silicon carbide.

15. A holder furnace, comprising:

a storage vessel having sidewalls and a bottom wall defining a molten metal receiving chamber for containing a supply of molten metal;

at least one furnace insulating layer lining the molten metal receiving chamber of the storage vessel;

a thermally conductive heat exchanger block located at the bottom of the molten metal receiving chamber for heating the supply of molten metal, with the heat exchanger block having a top face, a bottom face, and side faces, and with the heat exchanger block having a plurality of electrical heaters extending therein and projecting outward from at least one of the faces of the heat exchanger block and further extending through the furnace insulating layer and at least one of the sidewalls of the storage vessel for connection to a source of electrical power;

a sealing layer covering the bottom face and side faces of the heat exchanger block such that the heat exchanger block is substantially separated from contact with the furnace insulating layer, with the sealing layer further extending along a portion of the top face of the heat exchanger block, and with the furnace insulating layer overlapping the sealing layer extending along the portion of the top face of the heat exchanger block; and a gas pressurization valve in fluid communication with the molten metal receiving chamber, and in fluid communication with the interior of the heat exchanger block through the electrical heaters, with the gas pressurization valve configured for connection to a gas pressurization source and further configured to pressurize the molten metal receiving chamber and the heat exchanger block upon connection to the gas pressurization source and activation of the gas pressurization valve.

16. The holder furnace of claim 15, further comprising a cover positioned on top of the storage vessel and enclosing the molten metal receiving chamber, with the cover including a first conduit extending therethrough and in fluid communication with the gas pressurization valve for pressurizing the molten metal receiving chamber, and with the cover further including a second conduit extending therethrough for removing molten metal from the molten metal receiving chamber upon pressurization.

17. The holder furnace of claim 15, wherein the portion of the electrical heaters extending outward from the sidewall of the storage vessel is enclosed in a chamber connected to the gas pressurization valve and configured for pressurization upon activation of the gas pressurization valve.

18. The holder furnace of claim 15, wherein the sealing layer comprises an alumina fiber mat.

19. The holder furnace of claim 15, wherein the heat exchanger block is made of one of graphite and silicon carbide.

20. The holder furnace of claim 15, wherein the electrical heaters extend between opposite sidewalls of the storage vessel and through the heat exchanger block, wherein the electrical heaters each include a continuous heating element extending through at least one of the opposite sidewalls, the at least one furnace insulating layer, and extending at least partially through the heat exchanger block, and wherein the electrical heaters each further include respective tubes extending through the opposite sidewalls, the at least one furnace insulating layer, and extending at least partially into opposite faces of the heat exchanger block, with the heating element for the electrical heaters extending at least partially through each of the respective tubes.

21. The holder furnace of claim 20, further including sealing gaskets positioned within the heat exchanger block, and wherein the sealing gaskets cooperate, respectively, with ends of the tubes extending into the opposite faces of the heat exchanger block for preventing molten metal from leaking into the tubes and contacting the heating element of the electrical heaters.

22. The holder furnace of claim 21, wherein the tubes are ceramic insulating tubes and are each surrounded by a layer of ceramic fiber rope for preventing molten metal from the supply of molten metal from leaking into the ceramic insulating tubes and contacting the heating element of the electrical heaters.

23. The holder furnace of claim 22, further including flange plates attached, respectively, to the ceramic insulating tubes at the opposite sidewalls of the storage vessel, and wherein the ceramic insulating tubes are held in compression against the opposite sidewalls of the storage vessel by the flange plates and mechanical fasteners.

24. The holder furnace of claim 15, wherein the portion of the top face of the heat exchanger block having the sealing layer thereon defines a non-linear path such that any molten metal leakage into the furnace insulating layer follows a torturous path along the sealing layer.

25. The holder furnace of claim 15, wherein the portion of the top face of the heat exchanger block having the sealing layer thereon defines a plurality of ribs such that any molten metal leakage into the furnace insulating layer follows a torturous path along the sealing layer.

* * * * *

UNITED STATES PATENT AND TRADEMARK OFFICE

CERTIFICATE OF CORRECTION

PATENT NO. : 6,451,248 B1
DATED : September 17, 2002
INVENTOR(S) : Michael J. Kinosz et al.

It is certified that error appears in the above-identified patent and that said Letters Patent is hereby corrected as shown below:

Column 1,
Line 16, "injection molten metal" should read -- injection casting machine in which molten metal --.

Column 4,
Line 33, "layer34" should read -- layer 34 --.

Column 6,
Line 21, "Augusta. Georgia" should read -- Augusta, Georgia --.
Line 28, "However." should read -- However, --.

Column 11,
Line 22, "h eating" should read -- heating --.
Line 32, "thermafly" should read -- thermally --.

Signed and Sealed this

Eighth Day of April, 2003

JAMES E. ROGAN
*Director of the United States Patent and Trademark Office*